United States Patent [19]

Sigvardt et al.

[11] Patent Number: 4,513,956

[45] Date of Patent: Apr. 30, 1985

[54] CONVEYING DEVICE FOR SHEETS

[75] Inventors: Niels H. Sigvardt, Humlebaek; Jan A. Baranski, Herlev, both of Denmark

[73] Assignee: Océ-Helioprint AS, Kvistgaard, Denmark

[21] Appl. No.: 460,245

[22] PCT Filed: May 25, 1982

[86] PCT No.: PCT/DK82/00049

§ 371 Date: Jan. 18, 1983

§ 102(e) Date: Jan. 18, 1983

[30] Foreign Application Priority Data

May 25, 1981 [NL] Netherlands ..... 8102551

[51] Int. Cl.[3] ..... B65H 5/08

[52] U.S. Cl. ..... 271/9; 271/11; 271/94; 271/154; 271/30.1

[58] Field of Search ..... 271/9, 11, 12, 13, 94, 271/98, 30 R, 31, 127, 154, 155

[56] References Cited

U.S. PATENT DOCUMENTS 3,572,686 3/1971 Day ..... 271/94 X 3,990,696 11/1976 Landa ..... 271/98 X 4,066,253 1/1978 Lundbald ..... 271/4

*Primary Examiner*—Richard A. Schacher

*Attorney, Agent, or Firm*—Albert C. Johnston; Thaddius J. Carvis

[57] ABSTRACT

Device for the conveying of sheets from each of a plurality of sheet piles via a partially common conveyor track. This track extends in vertical direction along superposed stock holders. Adjacent to the sheet delivery side a driven roller is stationarily arranged above each pile. Each of these rollers can function both as suction roller for separating sheets from a pile and as friction roller for conveying sheets in the common track. For separating sheets from a pile, each pile can be brought by pneumatic means into short contact with a driven roller then functioning as a suction roller. For conveying sheets in the common track, each roller cooperates with a pressure roller. After a sheet in the common track has been gripped between a driven roller and a pressure roller, the sucting action of that driven roller is interrupted.

14 Claims, 6 Drawing Figures

Figure 1:
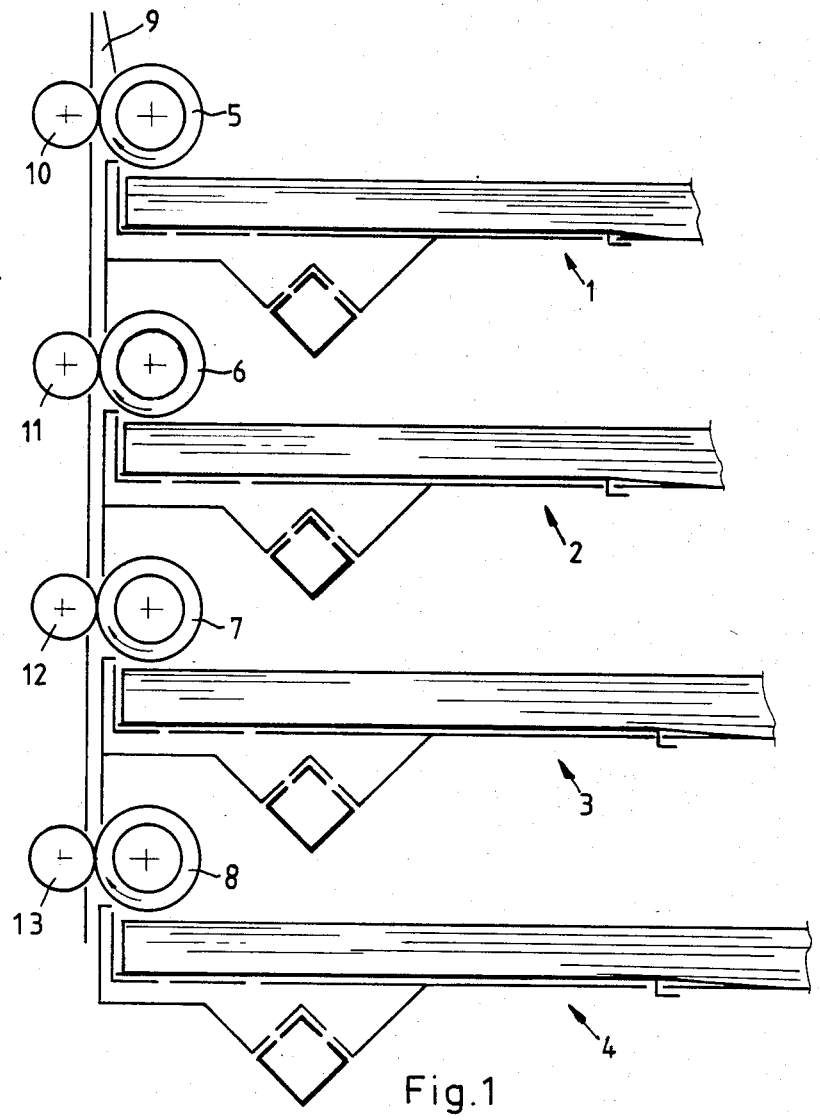

35
V
V
35
37
36
34

39
38

35
35
36
34
37

CONVEYING DEVICE FOR SHEETS

The invention relates to a device for the conveying of sheets to a processing station, comprising at least two stock holders for sheet piles, in which each sheet pile is provided with a separation roller which can be activated selectively in order to convey a sheet from a stock holder to a processing station, and conveyor tracks provided with conveyor elements which connect the stock holders to the processing station.

Such a device is known from the Netherlands patent application No. 7404899.

A device is described therein which is provided with a number of stock holders with means forming part of each stock holder to separate a sheet from the pile included therein and means to convey that sheet to an exposure station. The feed from the various stock holders to the exposure station is effected according to the abovementioned Netherlands patent application No. 7404899 via entirely separated conveyor tracks. The feed of sheets via entirely separated conveyor tracks has as a disadvantage that a large number of conveyor and driving means are required, which requires a complicated sheet feeding system requiring a lot of space.

The object of the invention is to provide a conveying device for sheets which does not have the abovementioned disadvantage, and which is able to convey sheets with a relatively small number of conveyor and driving means from one of a number of stock holders to a processing station.

According to the invention this object is achieved in that the conveyor track for each stock holder which is situated nearer to the processing station coincides with a part of the conveyor track for each holder situated further away from the processing station, in that the conveyor elements at least partially consist of roller pairs of which each time the driven roller is formed by a separation roller and in that when one separation roller is activated, all rollers are driven in a rotating way. In this manner it is achieved that with a relatively small number of conveyor and driving means sheets from one of a number of stock holders can be conveyed to a processing station in such a way that a simple sheet feeding system taking little space is created.

Preferably, each separation roller in a non-activated position is not in contact with the sheet pile and means are available which when the separation roller is activated, effect a contact between the separation roller and the sheet pile.

In this way it is achieved that with simple means it is guaranteed that sheets can only be fed from the selected stock holder.

Preferably the sheet pile at least partially rests on a movable plate which has been fitted against a wall of a space which can be connected to a compressed air source and discharge openings are formed in the wall.

In this way it is achieved that each separation roller can be installed in a fixed position and that the sheet pile forming part of the activated separation roller can only come into contact with the separation roller during excitation by compressed air.

Preferably the separation roller is formed by a suction roller. In this way it is achieved that during the separation a sheet can simply be kept in contact with a circumferential part of the separation roller in order to be able to branch off the sheet in the conveyor track formed by roller pairs.

Preferably the suction roller is formed by a hollow cylindrical tube which on the outer surface is provided with a coating in which a number of borings have been fixed, the borings being connected to the space inside the hollow tube via a number of saw cuts fitted perpendicularly to the axis of the tube, of a depth which is smaller than half the diameter of that tube.

In this way it is achieved that a simple constructed suction roller is obtained which at the same time can function as a friction conveyor roller.

Figure 2:
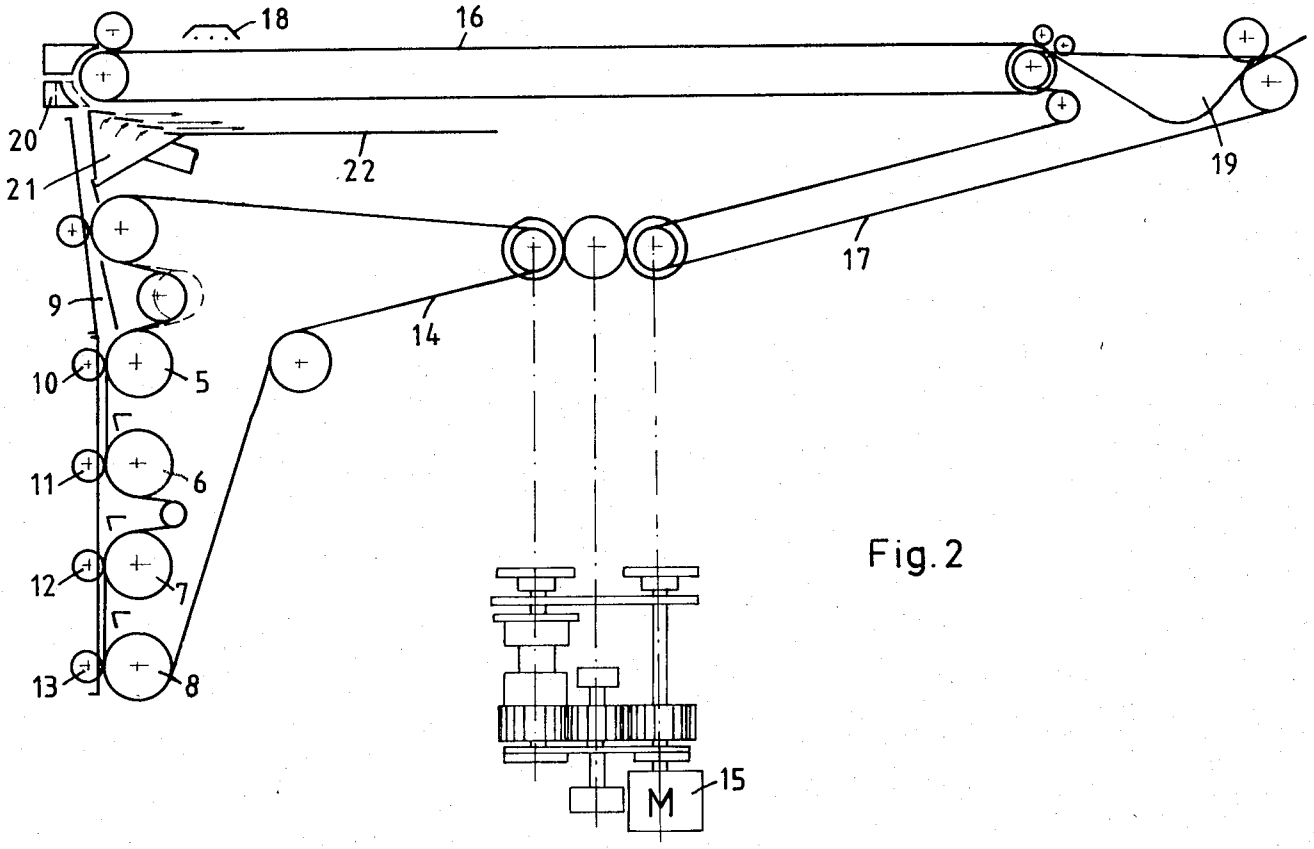
Figure 3:
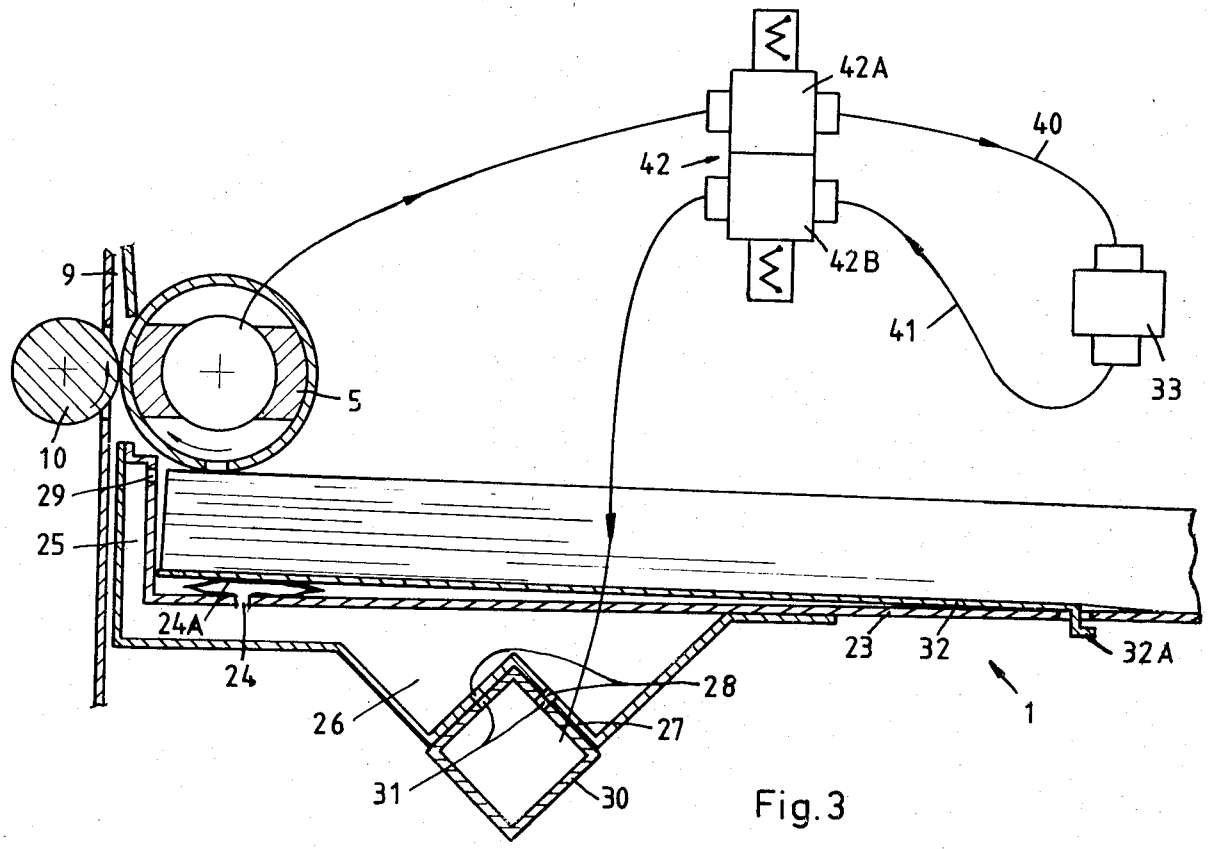
Figures 4, 5, 6:
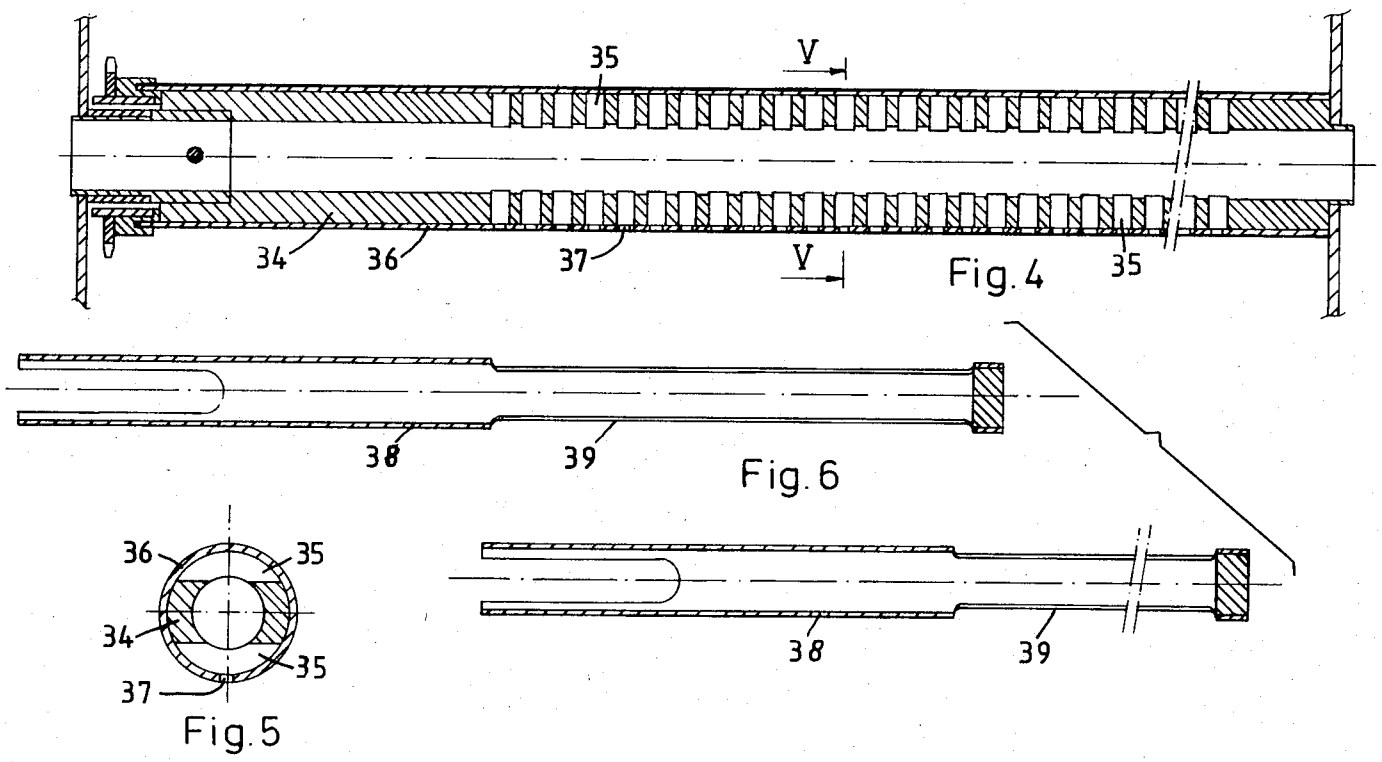

Other characteristics and advantages of the invention will become clear from the description given below of a preferred embodiment reference being made to the attached drawings, in which:

FIG. 1 is a diagrammatic cross section of a number of stock holders situated above one another, FIG. 2 is a diagrammatic cross section of a part of an electrophotographic copying machine, in which a device for the conveying of sheets according to the invention, can be used, FIG. 3 is a cross section of a stock holder with connected air pressure system, FIG. 4 is a longitudinal section of a separation roller, FIG. 5 is a cross section of a separation roller according to line V—V of FIG. 4, and FIG. 6 is a slide axially shifted in two positions which can be fitted in a separation roller.

FIG. 1 shows a cross section of a number of stock holders 1, 2, 3 and 4 situated above one another, in each whereof a pile of sheets can be accomodated. The stock holders can be arranged for acceptance of sheet piles of different sizes, for example of sizes A4, A3, A2 and A1.

In fixed positions, at some distance above the discharge side of each sheet pile a separation roller 5, 6, 7 and 8, respectively is mounted. These separation rollers are, when the device is in operation, driven in a rotating way and are able, in the manner described below, to discharge sheets from a pile and to supply to a joint conveyor track 9 which extends almost vertically alongside the discharge side of the stock holders. The conveying of sheets in this conveyor track is obtained by pressure rollers 10, 11, 12 and 13 which cooperate with the driven separation rollers 5, 6, 7 and 8 respectively and form roller pairs with these respectively.

As shown in FIG. 2, which represents an electrophotographic copying machine in which the invention can be applied, the separation rollers 5, 6, 7 and 8 are driven simultaneously via a joint drive element 14 which is kept in motion by a drive motor 15 when the device is switched on. A sheet supplied by the abovementioned roller via conveyor track 9 is fed to an endless conveyor belt 16 which extends horizontally above the stock holders. Conveyor belt 16 can be driven in two directions by motor 15 via a transmission and drive element 17.

The flat part directed upwards of conveyor belt 16 forms the exposure place of fed photoconductive receiving sheets. A charging unit 18 is placed above the conveyor belt 16 in a fixed position which is situated upstream of the exposure place. When the charging unit is in operation a fed photoconductive receiving sheet reaches the exposure place in a charged condition. The receiving sheet is kept in the desired exposure position by interrupting the drive of conveyor belt 16.

By means of an optical system not-shown an image of an original, for instance a microfilm, can be projected onto a receiving sheet positioned in the exposure plane in order to form a latent electrostatic image thereon.

Upon further conveying from the exposure position the receiving sheet is guided part a developing device 19 in order to develop the latent charge image.

In order to enable the operator to carry out the optical adjustment on a sheet positioned in the exposure position it is desirable that a photoconductive receiving sheet can be brought into the exposure position in an uncharged condition.

After this adjustment has been carried out, the receiving sheet concerned can still be charged by moving the conveyor belt in the opposite direction until the receiving sheet has passed the charging device entirely, after which the receiving sheet, with the charging unit switched on, is again fed to the same exposure position. In order to avoid during the returning conveyance that the receiving sheet arrives in the vertical conveyor track 9, a branching element 20 is brought into the dotted-line position during this conveyance. At the same time an air stream from space 21 is directed at the receiving sheet in order to guide it over a plate 22 which has been fitted underneath the conveyor belt 16. In an alternative way during the returning conveyance the receiving sheet may be guided along a vertical guide track parallel to the conveyor track 9. By these means branching element 20 and air supply from space 21 can be avoided. After exposure of a charged receiving sheet, conveyor belt 16 takes the receiving sheet provided with a latent image to a developing device 19, after which the finished copy leaves the copying machine.

The position which a receiving sheet can occupy in the exposure plane is adjustable, for instance depending on the size of the fed receiving sheet or on the desired position of the projected image on the receiving sheet.

Seen in the direction of movement a positioning is obtained by stopping the movement of the conveyor belt 16 at the moment that the receiving sheet has reached the desired position.

In the direction perpendicular to the direction of movement a positioning can be obtained by fixing the stock holders in the copying machine movably in that direction.

The effective operating area of the separation rollers, 5, 6, 7 and 8 respectively, mounted in a fixed position can be brought in accordance with the occupied position of the sheet pile in question in a manner described below on the basis of FIGS. 4, 5 and 6.

The stock holders can if necessary be moved in a transverse direction up to outside the machine, in order to make them accessible for putting in a new pile.

The new invention will now be further described on the basis of FIG. 3, which shows a stock holder. The other stock holders are built up analogously.

Each stock holder is formed by a bottom plate 23 and a raised edge 25 on the discharge side.

The bottom plate is provided with openings 24 near the discharge side. An expandable air bag 24A is connected to the upper side of the bottom plate 23 and communicates via openings 24 to space 26. Part of the bottom plate 23 and the raised edge are double-walled to form the enclosed space 26. This space is limited on the underside by a V-shaped part 27 which is provided with openings 28. Raised edge 25 is provided with openings 29 in the wall directed to the pile and in fact at the height of the upper side of an inserted sheet pile. The stock holder can slide with the V-shaped part 27 over a cylinder 30 fitted in a fixed position and which is provided with openings 31. These openings 31 form together with openings 28 a connection between cylinder 30 and space 26. The cylinder is, via a compressed air line, connected with a compressed air source 33, so that via openings 31 and 28 an increased air pressure can be achieved in space 26.

With bottom plate 23 a cover plate 32 is connected by hinges. The hinges can be formed by a flanged edge 32A of the cover plate, which protrudes through openings fitted in the bottom plate. Cover plate 32 carries the inserted pile or a part of the inserted pile. When an increased air pressure is effected in space 26, the air flowing through openings 24 will press up cover plate 32, as a result of which the top sheet of the pile resting on this will be brought into contact with separation roller 5, 6, 7 or 8 placed in a fixed position above the pile. At the same time, via openings 29 in the raised edge 25 of the stock holder, air can be blown against the front of the pile in order to detach the leading edges of the sheets from one another.

Each separation roller 5, 6, 7 and 8 is arranged to keep a sheet by underpressure by connecting each roller with the suction line of the above-mentioned compressed air source 33.

According to FIGS. 4 and 5 each separation roller is built up from a hollow cylindrical tube 34 provided with openings 35 obtained by saw cuts and covered by a sheath 36 of resilient material, for example rubber, provided with openings 37 which are connected to openings 35 in the tube. One tube end is linked to the suction line of compressed air source 33 in order to create underpressure in the roller. A roller thus built up may function as a friction conveyor roller and as a suction conveyor roller.

Each separation roller is preferably of the same length. This has its advantages in connection with the manufacture and assembly between the same frame plates inside a copying machine. If a separation roller has to cooperate with a narrower sheet pile, the suction width of the separation roller to the pile width may be limited by bringing a hollow cylindrical slide 38 into the roller. This slide shown in FIG. 6 in two positions is provided with slots 39 running parallel to the rotation axis at the length of the pile width. Only at the places of these slots the separation roller will be able to work as a suction conveyor roller. By axial shifting of the slide in the separation roller the suction area of the separation roller can be shifted depending upon the position of the stock holder.

On the basis of FIG. 3 the removal of a receiving sheet from the pile in accordance with the invention will now be described.

A compressed air source creates simultaneously an underpressure in line 40 and an overpressure in line 41. When a sheet has to be removed from the pile, two valves 42A en 42B are simultaneously opened in valve block 42 in order to effect simultaneously an underpressure in one of the separation rollers 5, 6, 7 or 8 and an overpressure via one of the cylinders 30 in a space 26.

As a result of an increase of the air pressure in this space 26 the cover plate 32 moves upwards, so that the pile resting thereon comes into contact with a separation roller 5, 6, 7 or 8, in which at that moment there is an underpressure. The separation roller sucks the top sheet when the openings situated in an axial line therein come into contact with that sheet. Via openings 29 in the raised edge 25 of the stock holder air is simultaneously blown against the discharge side of the pile in order to prevent that more than one sheet is carried off by the separation roller. Then the valve 42B is closed as a result of which the pile returns again to its original position. The separation roller keeps one sheet sucked up for at least one quarter of a revolution until the leading edge has come into contact with the pressure roller which cooperates with the separation roller. At that moment the valve 42A in valve block 42 is closed, as a result of which the separation roller no longer functions as a suction roller. The roller pairs formed by a separation roller and a pressure roller operate further as friction conveyor rollers in order to convey receiving sheets taken from piles situated lower to a processing station.

It is clear that the invention is not restricted to the embodiment described above, but that within the framework of the invention numerous modifications are possible. It is possible, for instance, to effect the briefly required overpressure in space 26 and the simultaneously briefly required underpressure in one of the separation rollers 5, 6, 7 or 8 in different manners, for instance by effecting air displacement by means of a plunger.

We claim:

1. An apparatus for conveying sheets to a processing station, comprising: a plurality of sheet stack holders spaced apart along a conveyor path leading to said processing station; conveyor means for delivering a sheet from a stack on any selected one of said holders into said path and then along said path to said station, said conveyor means including a plurality of roller pairs mutually spaced apart along said path, each of said pairs comprising two relatively fixed rollers forming a nip to advance along said path a sheet gripped in the nip, with one roller of each pair disposed in part over a said stack holder and being selectively activatable to serve as a separation roller for feeding a sheet from the stack holder into said path; the portion of said path that leads from each stack holder situated nearer to said processing station coinciding with a portion of said path that leads from each stack holder situated farther from said processing station; means for bringing a sheet stack on any selected one of said holders and the related separation roller in engagement and for activating that roller so as to feed a sheet from that stack into said path; and means operable when one of said separation rollers is activated to rotate all rollers of said pairs in unison.

2. An apparatus according to claim 1, said conveyor path being substantially vertical and each of said sheet stack holders being disposed substantially horizontally and transverse to said conveyor path.

3. An apparatus according to claim 1, each said stack holder comprising a movable plate for at least partially supporting a sheet stack, and comprising pneumatic means including an airexpansible chamber adjacent to said plate and means for admitting compressed air into said chamber to expand it and thereby displace said plate so as to effect said engagement.

4. An apparatus according to claim 3, said pneumatic means including an air space bounded in part by a wall having openings therein for passage of compressed air therethrough into said chamber and said plate being pivotable relative to said wall in response to the admission of compressed air into said chamber through said openings.

5. An apparatus according to claim 1, 3 or 4, each of said separation rollers comprising means for holding a sheet to its surface by suction.

6. An apparatus acording to claim 5, each of said separation rollers comprising a hollow cylindrical tube the wall of which is formed with recesses spaced apart therealong and extending therethrough and transverse to its axis, with a resilient outer surface layer overlying said tube and openings communicating with said recesses, the depth of said recesses being less than half the diameter of said tube.

7. An apparatus according to claim 4, each of said separation rollers being connectable to a suction line of a compressed air source that has a pressure line connectable to lead compressed air to a said air space.

8. An apparatus for conveying sheets to a processing station, comprising: a plurality of sheet stack holders spaced apart along a conveyor path leading to said processing station, each sheet stack holder comprising a movable plate for at least partially supporting a sheet stack and means including an air space adjacent to said plate for receiving air under pressure to displace said plate and thereby dispose a sheet stack thereon in sheet feeding position; conveyor means for delivering a sheet from a stack on any selected one of said holders into said path and then along said path to said station; said conveyor means including a plurality of roller pairs mutually spaced apart along said path, each of said pairs comprising two relatively fixed rollers forming a nip to advance along said path a sheet gripped in the nip, with one roller of each pair being disposed in part over a said stack holder and being selectively activatable to serve as a separation roller for feeding a sheet from the associated sheet holder into said path, each said separation roller comprising means for holding a sheet to its surface by suction, the portion of said path that leads from each stack holder situated nearer to said processing station coinciding with a portion of said path that leads from each stack holder situated farther from said processing station; means for selectively activating any one of said separation rollers, including means for applying suction to the selected roller and means for admitting compressed air to the said space associated with that roller to displace the associated movable plate and effect contact between the selected separation roller and a sheet on its associated sheet stack; and means operable to rotate all rollers of said roller pairs in unison when one of said separation rollers is activated.

9. An apparatus according to claim 8, each of said separation rollers comprising a resilient surface effective to frictionally engage and advance a sheet being conveyed.

10. An apparatus according to claim 8, each said separation roller comprising means to prevent the application of suction to a sheet at that portion of the surface of the separation roller which lies in the conveyor path at the side of the nip of the roller pair toward the processing station.

11. An apparatus according to claim 8, said conveyor path being substantially vertical and each of said sheet stack holders being disposed substantially horizontally and transverse to said conveyor path.

12. An apparatus according to claim 8, each said air space being defined in part by a wall having openings therein for passage of compressed air therethrough and the associated stack supporting said plate is movable being displaceable relative to said wall to sheet feeding position in response to the admission of compressed air into said air space through said openings.

13. An apparatus according to claim 8, each of said separation rollers comprising a hollow cylindrical tube the wall of which is formed with recesses spaced apart therealong and extending therethrough and transverse to its axis, with a resilient outer surface layer overlying said tube and formed with openings communicating with said recesses, the depth of said recesses being less than half the diameter of said tube.

14. An apparatus according to claim 8, 12 or 13, each of said separation rollers being connectable to a suction line of a compressed air source that has a pressure line connectable to lead compressed air to a said air space.

* * * * *